US010684577B1

(12) United States Patent
Bennett et al.

(10) Patent No.: US 10,684,577 B1
(45) Date of Patent: Jun. 16, 2020

(54) IMAGING TRANSFER TO INTERMEDIATE TRANSFER MEMBER

(71) Applicant: LEXMARK INTERNATIONAL, INC., Lexington, KY (US)

(72) Inventors: Christopher Michael Bennett, Paris, KY (US); Matthew David Heid, Louisville, KY (US); Gina Marie Johns, Georgetown, KY (US); Michael Craig Leemhuis, Nicholasville, KY (US); Christopher David Strack, Lexington, KY (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 0 days.

(21) Appl. No.: 16/207,512

(22) Filed: Dec. 3, 2018

(51) Int. Cl.
*G03G 15/16* (2006.01)

(52) U.S. Cl.
CPC ..... *G03G 15/162* (2013.01)

(58) Field of Classification Search
CPC ..... G03G 15/1675; G03G 15/1665; G03G 15/1605; G03G 15/0266; G03G 15/80
See application file for complete search history.

(56) References Cited

U.S. PATENT DOCUMENTS

| | | | | |
|---|---|---|---|---|
| 6,173,148 | B1 * | 1/2001 | Matsuda | G03G 15/1685 399/310 |
| 6,643,489 | B2 * | 11/2003 | Omata | G03G 15/232 399/21 |
| 6,681,094 | B2 | 1/2004 | Horrall | |
| 7,106,997 | B2 | 9/2006 | Stulc | |
| 2005/0134874 | A1 | 6/2005 | Overall et al. | |
| 2006/0067742 | A1 * | 3/2006 | Hattori | G03G 15/0121 399/283 |
| 2008/0240801 | A1 | 10/2008 | Chiba | |
| 2012/0282001 | A1 * | 11/2012 | Akashi | G03G 15/0131 399/308 |
| 2013/0266336 | A1 | 10/2013 | Maeda et al. | |
| 2014/0227012 | A1 * | 8/2014 | Honda | G03G 15/2028 399/322 |
| 2014/0243465 | A1 | 8/2014 | Matsushita et al. | |
| 2015/0003880 | A1 | 1/2015 | Ohno et al. | |
| 2015/0346642 | A1 * | 12/2015 | Uno | G03G 15/161 399/101 |
| 2017/0227895 | A1 | 8/2017 | Shibuya | |

* cited by examiner

*Primary Examiner* — Walter L Lindsay, Jr.
*Assistant Examiner* — Jessica L Eley

(57) ABSTRACT

An imaging device has first image transfer from photoconductive drums to an intermediate transfer member (ITM) and second image transfer from the ITM to media. Transfer rolls oppose the drums from an opposite side of the ITM and electrically ground to a frame of the imaging device by mechanical connection. The rolls may be laterally offset from the drums. The ITM has relatively low surface and volume resistivity. An imaging subassembly may include the frame, the ITM, and the transfer rolls grounded to the frame.

20 Claims, 3 Drawing Sheets

IMAGING TRANSFER TO INTERMEDIATE TRANSFER MEMBER

The present disclosure relates to electrophotographic imaging devices, such as printers, copying machines, multifunction devices, etc. It relates further to transferring images from photoconductive drums to an intermediate transfer member.

BACKGROUND

Color imaging devices contain two or more cartridges. Each transfers a different color of toner to a media sheet as required to produce a full color copy of a toner image. A common imaging device includes four separate color cartridges of toner—cyan, yellow, magenta, and black. Image formation includes moving toner from a reservoir to an imaging unit where toned images, black or color, are formed on photoconductive (PC) drums prior to transfer to a media sheet or to an intermediate transfer member (ITM) for subsequent transfer to a media sheet.

When transferring to an ITM, such as an endless belt, electrically biased backup rolls align with and create a nip with the PC drums that the ITM moves through in an endless loop. Polyurethane foam or other soft material forms the backup rolls so that the nip is relatively pliable. A controller directs application of differing voltages from a power supply to the drums and backup rolls that causes electrostatic transfer of the toned image from the drums to the ITM. This, however, requires the imaging device to have a complex power supply and necessitates power cabling from the power supply to the rolls, both of which add cost to the imaging device. A need exists to overcome the foregoing and other problems.

SUMMARY

An imaging device has first image transfer from photoconductive drums to an intermediate transfer member (ITM) and second image transfer from the ITM to media. Transfer rolls oppose the drums from an opposite side of the ITM and electrically ground to a frame of the imaging device. The rolls may be laterally offset from the drums. The ITM has relatively low surface and volume resistivity. An imaging subassembly may include the frame, the ITM, and the transfer rolls grounded to the frame.

DETAILED DESCRIPTION OF THE EMBODIMENTS

Figure 1:
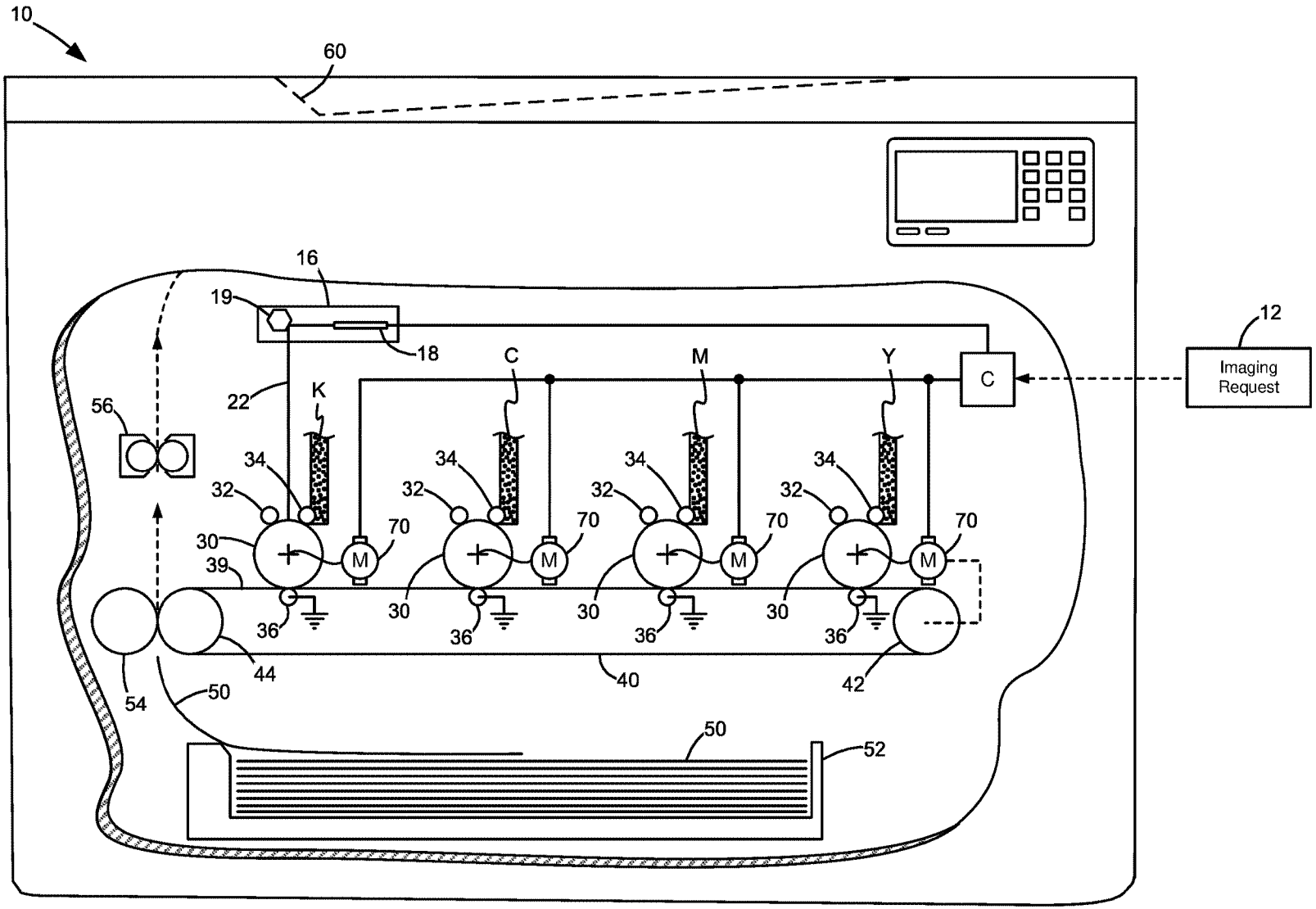
FIG. 1 is a diagrammatic view of an electrophotographic imaging device according to an example embodiment showing imaging transfer.

With reference to FIG. 1, there is shown an imaging device 10 having first and second imaging transfer. The device receives at a controller, C, an imaging request 12 for black-only or color imaging. The controller typifies an ASIC(s), circuit(s), microprocessor(s), or the like, including high and low voltage power. The request comes externally to the imaging device, such as from a computer, laptop, smart phone, etc. It can also come internally, such as from a copying or fax request. In any, the controller converts the request to appropriate signals for providing to a laser scan unit 16. The unit turns on and off a laser 18 according to pixels of the imaging request. A rotating mirror 19 and associated lenses, reflectors, etc. (not shown) focus a laser beam 22 onto one or more photoconductive drums 30, as is familiar. The drums correspond to supplies of toner, such as black (k) and one or more colored toners, such as cyan (c), magenta (m) and yellow (y). A corona or charge roller 32 sets a charge on a surface of the drums 30 as the drums rotate. The controller coordinates the amount of drum surface and core voltage. The core voltage exists as a negative voltage in a representative range of −200V to −600V. The laser beam 22 electrostatically discharges the drums to create an electrostatic latent image. A developer roller 34 introduces toner to the latent image and such is electrostatically attracted to create a toned image on a surface of the drums. At a location known as first image transfer, a voltage differential between the surface of the drums 30 and transfer rolls 36 causes transfer of the toned image from the drums to a surface 39 of an intermediate transfer member (ITM) 40. Namely, the transfer rolls 36 are electrically grounded, while the drums have a negative voltage, and the toned image is biased from the drums toward the rolls/belt. For monochromatic images, a toned image is applied to the ITM from a single photoconductive drum. For color images, toned images are applied from two or more photoconductive drums.

The ITM 40, being entrained about a drive roll 42 and one or more idler/tension rolls 44, moves in a process direction with the surface of the drums. A sheet of media 50 advances from a tray 52 to a transfer roll 54 where a second difference in voltage between the ITM and the transfer roll 54 causes the toned image to attract and transfer to the media 50 at the location known as second image transfer. A fuser assembly 56 then fixes the toned image to the media through application of heat and pressure. Users pick up the media from a bin 60 atop the printer after it advances out of the imaging device. One or more motors 70 exist to advance the media and rotate the drums and ITM.

Figure 2:
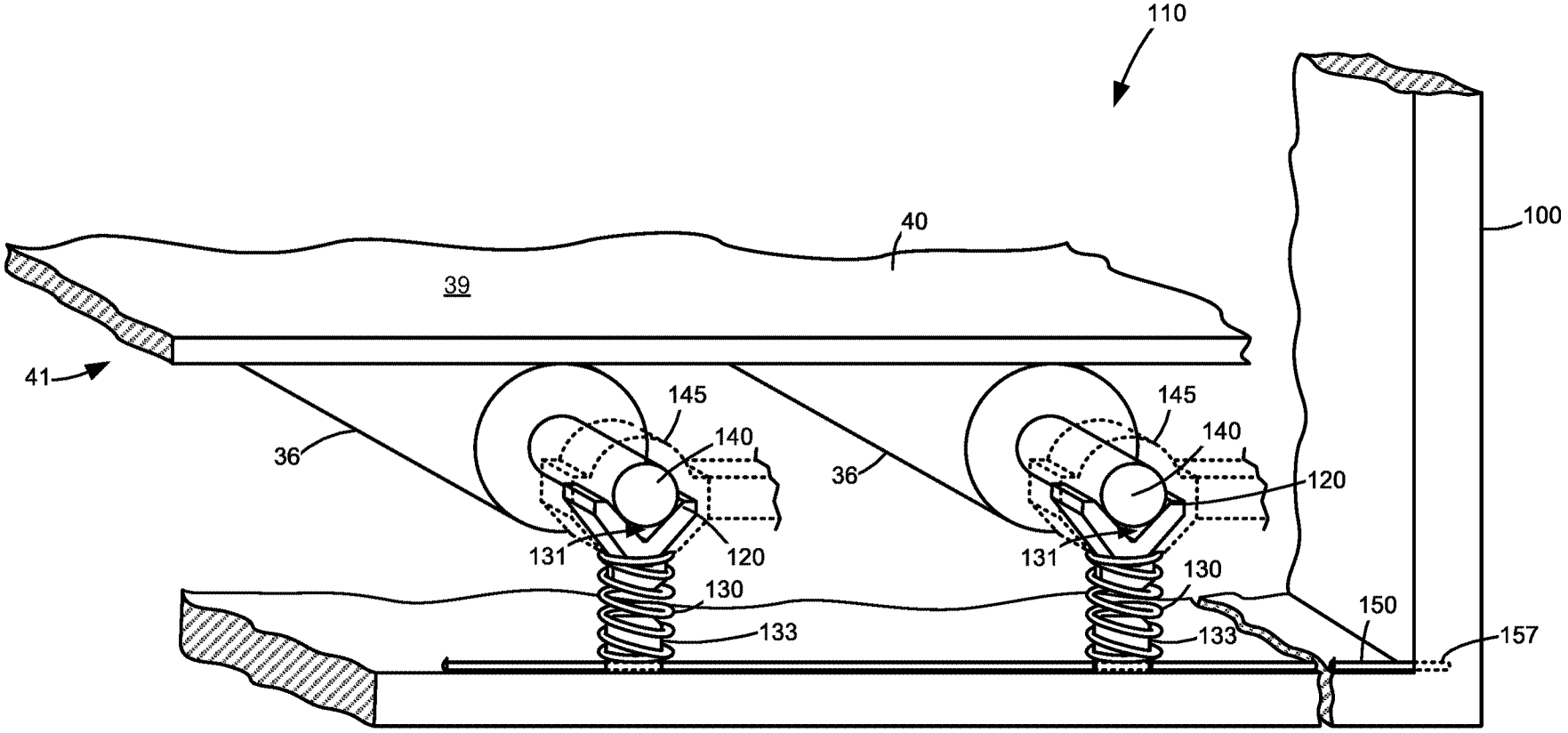
FIG. 2 is a diagrammatic view of transfer rolls electrically grounded to the imaging device.

With reference to FIG. 2, the ITM 40 defines an endless belt or loop entraining the transfer rolls 36 in an interior of the loop. The belt has a substantial uniform thickness of 50 to 200 microns between top and bottom sides or surfaces 39, 41. Its bottom surface contacts the transfer rolls 36 while its top surface is configured to contact the photoconductive drums at first image transfer. A frame 100 exists that supports both the transfer rolls 36 and the ITM in the imaging device. The frame may also define an imaging subassembly 110 that gets placed in an interior of the imaging device for mating with the photoconductive drum at the location of the first image transfer. To electrically ground the transfer rolls 36, a mechanical interconnection is provided between the rolls and the frame.

In one embodiment, conductive bushings 120 are biased upward to contact shafts 140 of the transfer rolls. The bushings could be of any shape, but one embodiment includes V-shapes and the shafts rest in notches of the "V," thereby allowing the shafts to rotate upon movement of the ITM. Torsion or compression springs 130 provide upward biasing and bottoms of the notches fit within diameters of the springs. The springs and bushings also contact one another. Bellcranks 145 provide intermediate connection positions between the springs and bushings to facilitate sound structural design. The bellcranks are shown in phantom for simplicity in the Figure and each connects to the frame 100. A boss of the bellcranks also fits within the diameter of the spring.

A conductive wire 150 extends in proximity to bottoms of each of the springs 130. The wire touches each of the springs and travels for support through bosses 133 of the frame en route to a terminal end 157 mechanically attaching to the frame 100. That the transfer roll, bushings, springs, wire and frame are all electrically conductive, each of the transfer rolls 36 have a common reference that defines electrical ground by connecting to the frame. It is representative that the bushings are made of conductive plastics, alloys, or metals, such as bronze, while the transfer roll and shaft are made of nickel plated steel. Other designs for the transfer roll that have worked satisfactorily include stainless steel, aluminum and anodized aluminum. Of course, others are possible. The bellcranks are also electrically conductive and, alternatively, are formed as a unitary piece in conjunction with the bushings. Similarly, the ITM is selected to have generally low resistivity. It can typify a polymer-based material infused with impurities, such as carbon black, giving it desired resistivity characteristics. It has been observed that a belt works satisfactorily with a low surface resistivity of $10^9$ ohms/square or less and/or a bulk or volume resistivity of $10^{10}$ ohms-cm or less. Of course, other materials may be used for the components of the embodiments.

Figure 3:
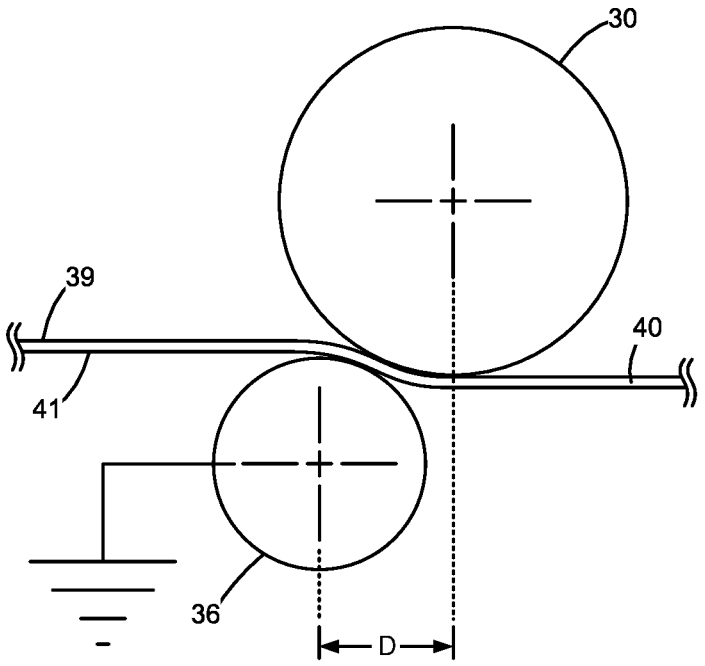
FIG. 3 is a partial view of an alternate embodiment of first image transfer.

With reference to FIG. 3, a nip defined by the transfer rolls and drums may further include an offset between the two. That is, an axis of rotation (+) of each the drums 30 and rolls 36 may reside in a lateral distance (D) of separation in a range of about 1 to about 10 mm, and more representatively about 5 to about 7 mm. The axes also generally parallel one another such that the transfer rolls and photoconductive drums have their respective longitudinal extents running parallel to one another. That the transfer rolls of the present embodiment are typically very hard, e.g., nickel plated steel, the offset provides a more pliable or forgiving nip for transit of the ITM when opposed by the drum 30. A flexure of the ITM 40 between the drum 30 and transfer roll 36 can be seen greatly exaggerated in the Figure.

In any embodiment, relative advantages of the embodiments should be now apparent to those skilled in the art. They include, but are not limited to, no longer requiring a power source to set voltages on the transfer rolls 36, thus being less expensive; and no longer requiring electrical cabling from the power source to the transfer rolls, thus being less expensive, again, and less complex as a lack of cabling no longer requires routing paths and placement in the imaging device. The use of imaging subassemblies in the imaging device also facilitates ease of manufacturing.

The foregoing description of several methods and example embodiments has been presented for purposes of illustration. It is not intended to be exhaustive or to limit the claims. Modifications and variations to the description are possible in accordance with the foregoing. It is intended that the scope of the invention be defined by the claims appended hereto.

The invention claimed is:

1. An imaging device having first and second image transfer, comprising:

a frame;

a photoconductive drum at the first image transfer;

an endless belt having first and second surfaces, the photoconductive drum contacting the first surface; and a transfer roll opposing the photoconductive drum while contacting the second surface of the endless belt and being directly electrically grounded to the frame thereby the transfer roll having no electrical bias, the photoconductive drum and the transfer roll each having an axis of rotation laterally separated from one another in a range from about 1 to about 10 mm.

2. The imaging device of claim 1, wherein the range is more narrowly about 5 to about 7 mm.

3. The imaging device of claim 1, wherein the endless belt has a surface resistivity equal to or less than $10^9$ ohms/square.

4. The imaging device of claim 1, wherein the endless belt has a volume resistivity equal to or less than $10^{10}$ ohms-cm.

5. The imaging device of claim 1, wherein the endless belt has a surface resistivity equal to or less than $10^9$ ohms/square and a volume resistivity equal to or less than $10^{10}$ ohms-cm.

6. The imaging device of claim 1, further including a conductive bushing biased into contact with a shaft of the transfer roll, the conductive bushing connecting electrically to the frame.

7. The imaging device of claim 6, wherein the conductive bushing is V-shaped, the shaft of the transfer roll rotating in a notch of the conductive bushing.

8. The imaging device of claim 1, wherein the transfer roll is nickel plated steel.

9. The imaging device of claim 1, further including a controller configured to cause charging of cores of the photoconductive drum during use in a range of −200V to −600V.

10. The imaging device of claim 1, wherein the endless belt, frame, and the transfer roll grounded to the frame define an imaging subassembly for placement in an interior of the imaging device for mating with the photoconductive drum at a location of the first image transfer.

11. In an imaging device having first and second image transfer, a method of transferring at the first transfer a toned image from a photoconductive drum to an intermediate transfer member, comprising:

directly grounding a transfer roll to a frame of the imaging device thereby imparting no electrical bias to the transfer roll, the transfer roll residing on an opposing side of the intermediate transfer member relative to the photoconductive drum, each of the transfer roll and photoconductive drum having an axis of rotation;

laterally offsetting from one another said each axis of rotation in a range from about 1 to about 10 mm;

charging the photoconductive drum to a negative voltage;

developing with toner a latent electrostatic image on the photoconductive drum to create the toned image;

rotating the toned image into contact with the intermediate transfer member; and because of the voltage differential between the photoconductive drum and the directly grounded transfer roll, transferring the toned image from the photoconductive drum onto the intermediate transfer member.

12. The method of claim 11, further including providing the intermediate transfer member as an endless belt with uniform thickness having a surface resistivity of $10^9$ ohms/square or less and a volume resistivity of $10^{10}$ ohms-cm or less.

13. The method of claim 11, wherein said laterally offsetting further includes a range of about 5 to about 7 mm.

14. The method of claim 11, further including providing the transfer roll as nickel plated steel.

15. The method of claim 11, further including biasing a conductive bushing into contact with a shaft of the transfer roll and grounding the conductive bushing to the frame.

16. The method of claim 11, further including charging a core of the photoconductive drum to a voltage of −200 to −600 V inclusive.

17. An imaging device having first and second image transfer, comprising:

a frame;

a plurality of photoconductive drums for creating latent electrostatic images that become developed with toner;

an intermediate transfer member for receiving from the photoconductive drums at the first image transfer the electrostatic images developed with toner, the intermediate transfer member being an endless belt with uniform thickness having a surface resistivity of $10^9$ ohms/square or less and a volume resistivity of $10^{10}$ ohms-cm or less; and a plurality of transfer rolls one each corresponding to each of the plurality of photoconductive drums and residing on an opposing side of the intermediate transfer member, said each of the plurality of transfer rolls being directly electrically grounded by mechanically connecting to the frame thereby imparting no electrical bias to any of the plurality of transfer rolls and being laterally offset from said each of the corresponding plurality of photoconductive drums.

18. The imaging device of claim 17, wherein the lateral offset exists in a range from about 5 to about 7 mm.

19. The imaging device of claim 17, further including conductive bushings biased into contact with a shaft of said each of the plurality of transfer rolls, the conductive bushings electrically connecting to the frame.

20. The imaging device of claim 17, wherein the endless belt, frame, and the plurality of transfer rolls grounded to the frame define an imaging subassembly for placement in an interior of the imaging device for mating with the plurality of photoconductive drums.

* * * * *